US006877423B2

(12) United States Patent
Beisswenger et al.

(10) Patent No.: US 6,877,423 B2
(45) Date of Patent: Apr. 12, 2005

(54) METHOD TO PRODUCE A PRINTING FORM FOR ROTOGRAVURE, PRINTING FORM FOR ROTOGRAVURE AND THEIR USE

(75) Inventors: Siegfried Beisswenger, Preetz (DE); Maximilian Rid, München (DE)

(73) Assignee: Hell Gravure Systems GmbH, Kiel (DE)

( * ) Notice: Subject to any disclaimer, the term of this patent is extended or adjusted under 35 U.S.C. 154(b) by 0 days.

(21) Appl. No.: 10/680,514

(22) Filed: Oct. 7, 2003

(65) Prior Publication Data

US 2004/0168595 A1 Sep. 2, 2004

(30) Foreign Application Priority Data

Oct. 17, 2002 (DE) ..... 102 48 602
May 27, 2003 (DE) ..... 103 24 327

(51) Int. Cl.[7] ..... B41L 16/00
(52) U.S. Cl. ..... 101/141; 101/349.1; 101/453
(58) Field of Search ..... 101/141, 453, 101/349.1, 130, 132, 136

(56) References Cited

U.S. PATENT DOCUMENTS 3,665,286 A * 5/1972 Ohno et al. ..... 363/27
4,029,013 A * 6/1977 George et al. ..... 101/389.1
5,252,360 A * 10/1993 Huttl et al. ..... 427/249.17
5,778,775 A * 7/1998 Schafer ..... 101/141
6,555,216 B2 * 4/2003 Chen et al. ..... 428/322.7

* cited by examiner

*Primary Examiner*—Stephen R. Funk
*Assistant Examiner*—Marissa Ferguson
(74) *Attorney, Agent, or Firm*—Schiff Hardin LLP

(57) ABSTRACT

In a method to produce a printing form for rotogravure, in particular for heliorotogravure, a surface of the formis provided with a wear-resistant layer and the surface is provided with cups. Furthermore, a printing form is provided whereby the surface of the printing form comprises a wear-resistant layer in which the cups, with regard to their depth, are at least partially provided therein. The printing form may be used in a printing device for heliorotogravure.

47 Claims, 1 Drawing Sheet

METHOD TO PRODUCE A PRINTING FORM FOR ROTOGRAVURE, PRINTING FORM FOR ROTOGRAVURE AND THEIR USE

BACKGROUND OF THE INVENTION

The invention concerns a method to produce a printing form for rotogravure (in particular for heliorotogravure) in which cups are provided in the surface of the printing form, a printing form for rotogravure (in particular for heliorotogravure), and the use of such a printing form in a print device.

Printing forms for rotogravure, also called print cylinders or engraving cylinders, are predominantly produced in the engraving devices by means of a recording unit in the form of a mechanical engraving unit or by means of an electron beam, laser beam or etching.

A sample to be reproduced is scanned with a scanning organ pixel by pixel and line by line in order to acquire an image signal which represents the tone values of the scanned sample. The image signal is corrected according to the requirements of the reproduction, for example according to a predetermined gradation curve, and superimposed with a raster signal to generate the print raster. The recording signal formed via the superimposition of image signal and raster signal controls the recording unit, which moves along in an axial direction on the rotating print cylinder and engraves a series of depressions or recesses (arranged in the print raster) called cups into the generated surface of the print cylinder. The scanning of the sample (which follows the previously specified principle) occurs nowadays as a rule only with electronic scanning of the sample. The image data supplied by the scanning are given to a computer in which a program-aided treatment and processing occur. In many cases, samples nowadays must no longer be scanned because photographs already exist in many cases as digital data, and text and graphics can likewise be generated on the computer in the form of digital data. The computer then supplies the image signal, based on which of the cups were provided in the generated surface of the print cylinder either mechanically or by means of laser direct engraving or a laser mask method. The depths or volumes of the engraved cups determine the tone value to be printed between "black" and "white", also designated in print technology terminology as "depth" and "light".

For the print process, the engraved print cylinder is then clamped in a rotogravure rotation machine.

Before the printing event, each cup accepts a quantity of printing ink, dependent on its volume, that corresponds to the tone value to be printed. In the printing event, the ink transfer then occurs from the cups to the printing material.

A rotogravure cylinder customary in practice is generally comprised of a cylinder core that can comprise steel, aluminum, and of late also a synthetic composite, and that is additionally provided with a coating (base layer), for example made of copper. The cups are engraved into this copper coating or into a further specially applied layer. Due to its physical and chemical properties, copper exhibits good engraving properties which aid the generation of high-quality printings. The thickness of the galvanically applied copper engraving surface is approximately 60 $\mu$m to 140 $\mu$m. Moreover, the copper layer to be engraved is polished, such that the surface is provided with a defined micro-roughness. The information to be printed, made up of image and text, is subsequently applied by means of a diamond engraving tool to the copper surface in the form of a fine cup raster.

However, what is disadvantageous in the use of copper as an engraving material is that it exhibits a relatively low hardness and abrasion resistance. Due to the mechanical requirements in the print process, with increasing operation period wear would occur on the copper layer via the scrapers, which reduces the print quality as well as the service life of the print cylinder and thus limits the circulation quantities. In order to improve the wear resistance of the engraved copper layer, and thus to increase the service life of the print cylinder, it is common in practice to degrease the engraved copper layer before the printing and subsequently to provide it with a layer made of a harder metal (with regard to copper), for example made of chromium, which for example can occur via a galvanization event. Before the finished printing form is inserted into the printing machine, the surface of the applied layer is polished.

After the printing, the layer, as well as the sub-adjacent copper layer comprising the engraving, is chemically, electrochemically, or mechanically removed. The print cylinder is thereby available for a new cycle to produce a further printing form.

Moreover, in rotogravure in the past, printing forms were produced by means of chemical and/or electrolytic etching, which has led to good results. The print cylinder was hereby coated with a masking layer, whereby a photographic exposure of the mask via film samples, the rinsing of the mask, and the etching of the copper surface with, for example, iron chloride subsequently occur.

What was disadvantageous was the low process safety and the insufficiently good depiction of halftones for images. The etching method was further modified in that on the one hand what is known as a photoresist, and on the other hand what is known as a thermoresist, were selected for the mask layer. In both cases, the mask layer was exposed (one also says illustrated) by a laser beam. In the case of the photoresist, the laser beam generates a photochemical conversion of the irradiated places of the resist layer, whereby a developing step is necessary before the etching to generate the finished mask. In the case of the thermal resist, the laser beam generates the finished mask in a step, in that the laser removes the mask layer via thermal processing where a cup should exist via etching. Both methods are complex in the sense that they comprise relatively many process steps. They are therefore susceptible in practice to quality faults. Moreover, they also have the fundamental disadvantage of all etching methods, namely that the halftones are poorly depicted for images.

Furthermore, it is known for generation of the cups on a print cylinder to use the electron beam engraving method applied in materials processing, that has shown very good results due to the high energy of the electron beam and the enormous precision with regard to the beam deflection and beam geometry. The cups are fired at high speed into the copper layer with an electron beam of higher power density. Due to the large expenditure and the high investment costs for an electron beam engraving machine, electron beam engraving was not previously used in practice for the engraving of copper cylinders for rotogravure, but rather only in the steel industry for surface engraving of what are known as texture rollers for the production of sheets, with which textures are rolled into the sheets.

Furthermore, it was attempted to use lasers for rotogravure engraving in order to engrave the print cylinder with an outer copper layer by means of a laser. However, since copper is a very good reflector of laser radiation, very large capacities, and in particular very high power densities are required of the laser to be used in order to melt the copper. In order to solve this problem, it was proposed to replace the copper layer that comprises the engraving with a zinc layer. The cups are fired into a zinc layer with a laser beam. The laser beam engraving of zinc requires overall less beam power than with copper. A substantial disadvantage of this method exists in that the galvanic application of zinc onto a rotogravure cylinder can be less reliable in industrial practice than when the layer comprising the engraving is copper.

As in the engraving of copper, the zinc layer must also be provided after the illustration (laser engraving) with a wear-resistant layer, for example made of chromium, in order to achieve a sufficient service life in the printing machine. The problem thereby exists that the application of chromium onto zinc functions as unreliably as the application of chromium onto copper, such that the combination of a zinc electroplating with a chromium electroplating is complicated. It is therefore necessary to implement further method steps. In addition to the difficult handling of zinc, disposal, in particular in combination with chromium, represents a further problem.

SUMMARY OF THE INVENTION

It is an object of the present invention to achieve a method with which printing forms can be produced and which provide durable and good printing results, whereby the printing form is simple to produce, and the production costs of such printing forms are kept at less than the production costs of printing forms produced in a previous conventional manner. The printing forms should be able to be used in printing devices without change to the printing devices, as they are used up to now for conventionally produced and designed printing forms.

The object is achieved in that the surface is provided with a wear-resistant layer.

DESCRIPTION OF THE PREFERRED EMBODIMENTS

Figure 1:
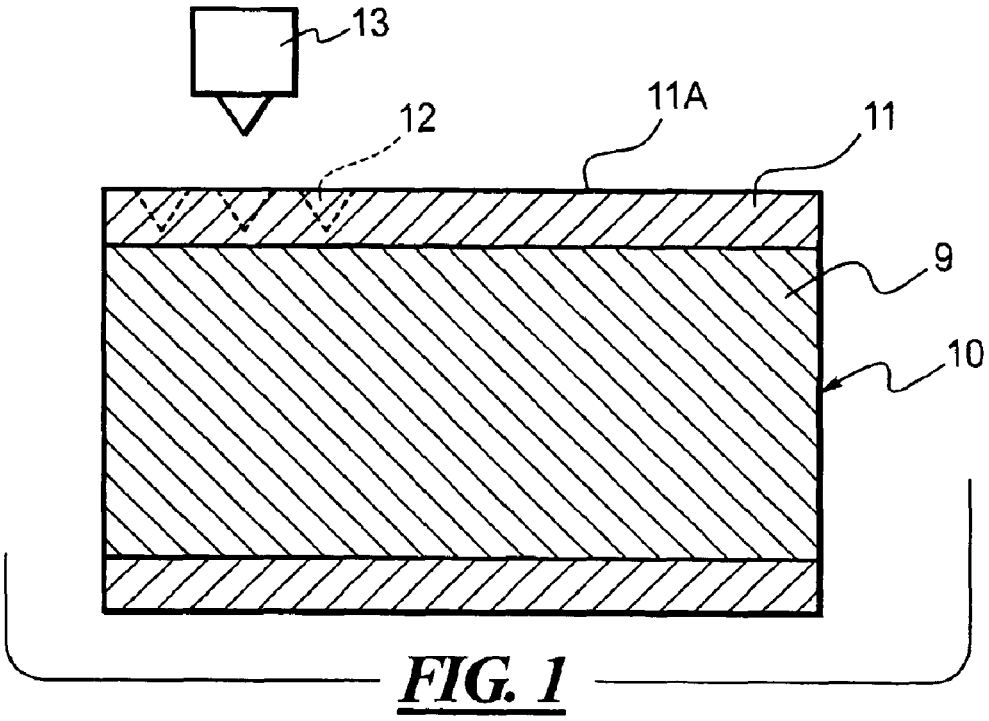
FIG. 1 is a cross-sectional view of the printing form in a first embodiment having a wear-resistant layer.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

Copper exhibits a Vickers hardness in the range of 40 kp/mm$^2$ (soft) up to the range of 110 kp/mm$^2$ (hard). Chromium exhibits a Vickers hardness in the range of 120 kp/mm$^2$ (soft) to 670 kp/mm$^2$ (hard)—specified in "Stoffsch ütte", 4th edition, 1978, pages 1102, 1103. For the wear-resistant layer of the preferred embodiment, all materials that have a greater Vickers hardness than copper, thus greater than 110 kp/mm$^2$, are advantageously considered in principle for the design of this layer.

Copper serves as an actual engraving layer on the printing form that is regularly designed as what is known as a print cylinder. As already described, chromium is applied to the copper layer in order to increase the service life of the printing form during its intended use. Two layers are also to be applied to the printing form, for which two separate galvanic baths must be provided, and as a result two separate galvanic coating events must be implemented.

Fundamentally, in the preferred embodiment one layer is to be applied to the printing form, which significantly reduces the production event of the printing form temporally and with regard to the production costs. For this, it is not mandatory to galvanically apply specific wear-resistant layers, which likewise has the advantage that, after the course of the intended duration of the printing form, the wear-resistant layer in most cases can be removed from the printing form again with simpler measures than before.

The advantage of the solution exists in that a wear-resistant layer can, dependent on the desired goal, be specifically selected with regard to the desired application of such a designed printing form, meaning that the hardness of the wear-resistant layer can be selected or adapted with regard to the available material that forms the wear-resistant layer. This selection can occur under consideration of the later removal of the wear-resistant layer from the printing form (the printing form after the course of the intended use period should be removed from the printing form) and, as the case may be, the disposal criteria also connected therewith.

According to an extraordinarily advantageous embodiment as shown in FIG. 1, the method is formed in that the wear-resistant layer 11 is provided on the core 9 of the printing form 10 before forming of the cups 12 with the engraving unit 13. It can thereby be achieved that the wear-resistant layer 11 forms the actual engraving surface 11A or engraving layer of the printing form. It can thereby be advantageously achieved that after completion of the formation of the cups, i.e. after completion of the engraving or illustration of the printing form directly into the wear-resistant layer, without further temporally elaborate preparation steps, the quasi-finished printing form can be inserted into the printing device for implementation of the printing event. Only the removal of material residues that arise in the course of the engraving or deburring and, as the case may be, an additional subsequent grinding, polishing, or cleaning event are, as the case may be, necessary. Via these further proposed advantageous solution modifications, the production method of the printing form is significantly reduced, both temporally and with regard to the costs to be expended.

It is emphasized that these (as the case may be) necessary after treatment steps can, in principle, even be implemented during the actual engraving but are, as the case may be, not at all necessary given conventional selection of the material of the wear-resistant layer.

The wear-resistant layer can advantageously be what is known as a hard material layer, for example, such a layer as are used for surface coating of cutting tools such as drills, cutter heads, and turning tools in order to increase their service lives. In principle, every known hard material used in the prior art for this purpose is suitable, for example boron carbide and its derivatives (to name this material here only as an example).

However, the wear-resistant layer can also advantageously be formed by a composite material that, for example, comprises a mixture of synthetic and particulate elements comprised therein. The particulate elements can thereby preferably be silica sand.

According to another advantageous embodiment of the method, the wear-resistant layer can also be formed from a metallic layer. The metallic layer can be formed on the one hand from elemental metal, and also on the other hand from metal alloy. The selection whether the layer is now designed from a metallic material, a hard material, or a composite material in the sense of the aforesaid can also be chosen dependent on the desired properties or properties to be provided in the printing form, and also with regard to the type of the printing with the printing form, the desired service life to be achieved, the removal of the wear-resistant layer, and the type of the implementation of the engraving of the printing form or the wear-resistant layer of the printing form.

The wear-resistant layers can regularly be implemented via the known coating methods, such as preferably the CVD method or the PVD method (Chemical Vapor Deposition, Physical Vapor Deposition), whereby these techniques are also well-tested on a large scale and can be controlled.

In this manner, by means of these known methods, hard material layers and metallic layers can be applied with high precision with regard to the uniformity of the coating and the desired thickness of the coating on a surface, here of the printing form.

For specific purposes, it is advantageous, for example in connection with the application of metallic layers, to apply these galvanically onto the printing form, whereby however metallic layers are also ultimately likewise applicable by means of the aforementioned PVD or, respectively, CVD method.

The mentioned composite materials can, for example, by applied by means of a spray event onto the surface of the printing form to fashion the layer, and are then hardened or cured thermally and/or also via irradiation by means of electrons.

Figure 2:
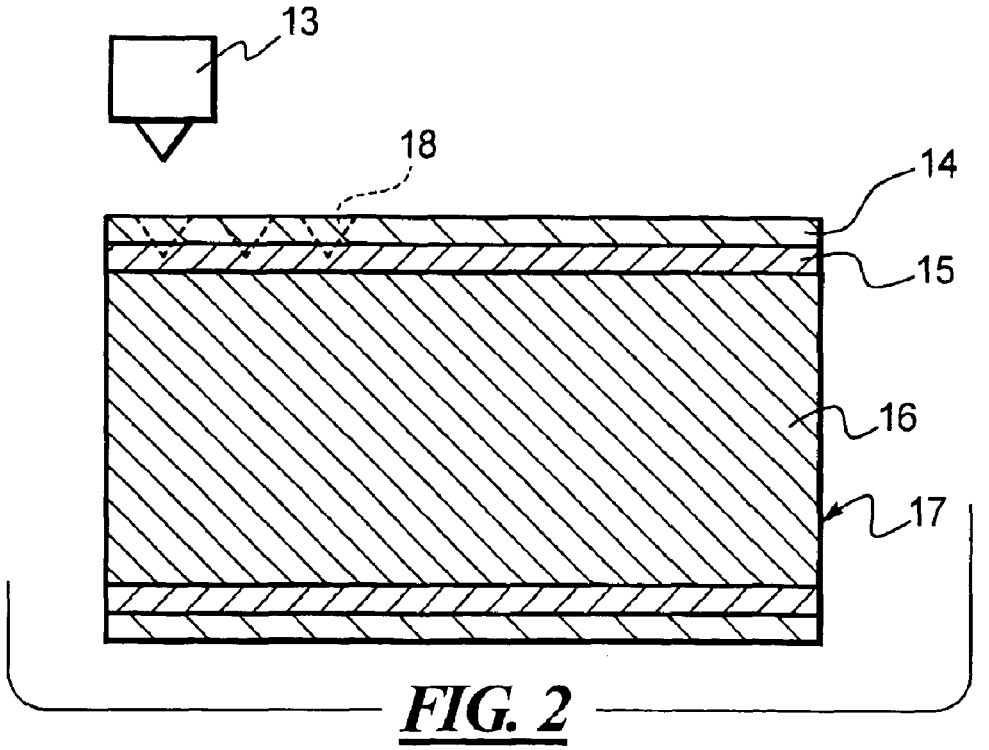
FIG. 2 is a cross-sectional view of a second embodiment of the printing form having a lower layer and a wear-resistant layer thereon.

As shown in FIG. 2, the thickness of the layer can thereby preferably be selected such that the cups 18 are at least partially provided in the wear-resistant layer 14, which ultimately holds true for all types of the layer composite and the application of the layers. This is to be understood such that, as shown in FIG. 2, the wear-resistant layer 14 is applied to a conventional layer 15 (for example made of metal such as copper or zinc) previously applied to the core 16 of the printing form 17, or to a non-metallic layer, and merely the surface-proximal region is formed by the wear-resistant layer, and the cups 18 in the area of the cup floor are provided in the layer 15 lying under the wear-resistant layer 14; however it is also possible to provide the thickness of the wear-resistant layer without a separate layer under the wear-resistant layer, preferably to provide the cups completely in the wear-resistant layer, as shown in the drawing figure.

Since the depth of the cups provided in the surface of a printing form, barring exceptions, is regularly advantageously in the range between 15 and 35 m, the wear-resistant layer is as a result to be advantageously designed in the range between 20 and 50 $\mu$m thick, whereby layer thicknesses in the range of up to 10 $\mu$m can be produced (by means of the known CVD and PVD methods) without difficulties and moreover also up to the range of 15 $\mu$m, meaning that such wear-resistant layers can also be produced (by means of these known PVD and CVD coating methods) on printing forms in which the cups are even completely provided without sub-adjacent layers, insofar as they are present, and are contacted by the cups.

Also in the proposed wear-resistant layer, the cups provided therein can fundamentally be provided in any suitable known manner, for example via the most varied known methods such as, for example, by means of a mechanical engraving means or an engraving my means of laser light. These different engraving methods are also selected dependent on the material forming the wear-resistant layer.

A mechanical engraving means is, for example, a graver made of a suitable formed diamond.

An engraving method by means of laser light can advantageously be selected such that the cups are directly provided by means of the laser light, i.e. high-energy laser light directly provides the cup in the wear-resistant layer with regard to its three-dimensional shape (length, breadth, depth).

However, it is also possible (occurring in turn dependent on the material forming the wear-resistant layer, the type of the material, the ability to be handled for providing the cups, the targeted service life of the designed printing form, and the later ability of removal of the wear-resistant layer), to also advantageously provide the cups via etching. Beforehand, before implementation of the etching event, a photoresist or a thermoresist is designed to form the etching mask on the wear-resistant layer. This known etching engraving technique, as it was used before and as used in print cylinders made of copper in which the cups were provided, can in principle also be applied here in conjunction with the etching of the wear-resistant layer. This also holds true for a further advantageous embodiment wherein the etching mask itself is exposed by means of a laser light.

Finally, it is advantageous to further form the method such that the surface of the wear-resistant layer is designed rough with a predetermined degree of roughness, in order to ensure a friction resistance of predetermined magnitude between the surface of the wear-resistant layer and the surface of the material (to be printed) corresponding with it during the printing event.

This degree of roughness preferably corresponds to what is known as a microroughness, that preferably is designed or achieved via polishing and/or grinding of the surface.

To achieve the above object, a printing form for rotogravure, in particular for heliorotogravure in which cups are provided on the surface of the printing form, comprises a wear-resistant layer on the surface in which the cups are at least partially provided with regard to their depth.

The advantage of such a printing form, likewise holding true for the advantages cited above with regard to the method of its production, also lies in that the printing form can be designed much more simply in comparison with the printing forms known in the prior art. Up to the formation of the cups, meaning up to its illustration, the printing form can be completely finished and stored until the printing form is needed for the illustration. If the engraving surface of the printing form were to consist of zinc or copper, as in conventionally produces printing forms, a storage would not be possible since zinc and copper surfaces are subject to a deterioration (aging) that would not allow the subsequent illustration and a subsequent chromium plating without further production steps.

The preceding specified printing form can preferably be produced according to the method according to one or more of the method steps as they were previously specified in detail. However, it is also possible to use fundamentally different method steps to produce the inventive printing form.

After the illustration of the preceding specified printing form or after the production of the printing form according to the method, the printing form can be inserted into a print device, in particular into a rotation printing machine, in order to conventionally print the material to be printed.

The method is subsequently once again specified in greater detail.

The starting point for the method to produce a printing form for rotogravure, in particular for heliorotogravure, is a printing form designed substantially cylindrical that regularly is comprised of a steel core, however can also fundamentally also be comprised of other materials, for example synthetic or plastic. A copper undercoating can be provided on this steel core that is applied to the steel core by means of known application techniques. However, other metallic undercoatings can also be applied to the steel core, for example a zinc undercoating. A wear-resistant layer is then applied to this metallic undercoating. The wear-resistant layer can thereby exhibit a thickness such that a subsequent illustration of the printing form (i.e. the formation of the cups) occurs in the layer without the sub-adjacent metallic undercoating being impinged upon by the cups or that the cups penetrate into this sub-adjacent undercoating.

However, it is to be noted that in principle no undercoating must be provided under the wear-resistant layer. Rather, it is also possible to provide the wear-resistant layer directly on the core element of the printing form, whether made of steel or another material.

After the wear-resistant layer has been applied, the printing form is illustrated according to a known manner which, depending on the selection, can occur by means of different engraving techniques.

The illustrated printing form, meaning the wear-resistant layer provided with the engravings, subsequently undergoes a surface treatment by polishing and/or grinding. The polishing and/or grinding can occur such that a predetermined roughness or microroughness of the surface is achieved. The polishing and/or grinding serves to remove unwanted residues of the wear-resistant layer that arise during the engraving event or the illustration. Burrs are also thereby removed. A separate cleaning event after the polishing and/or the grinding can be associated. However, these treatment steps can also occur in a work step during the engraving or the illustration. Dependent on the material of the wear-resistant layer, given specific materials no necessity exists whatsoever to implement a grinding, polishing or cleaning step after the illustration.

Even in the event that a grinding, polishing, or cleaning event should be necessary, this requires disproportionally much less effort in comparison to the corresponding steps as were necessary before the printing given classical engraving layers made of copper or zinc via chromium plating and a subsequent polishing.

After these production steps, the printing form is in principle qualified to be used for intended use in a printing device or in a rotation printing machine, and to conventionally implement the printing event of material to be printed, which occurs by means of known printing events.

In order to be able to again use the printing form after the intended printing, after the printing event the wear-resistant layer comprising the illustration is removed from the printing form, such that the printing form, in particular the print cylinder, is available for a new production cycle of the printing form, which in principle can occur repeatedly. The removal of the wear-resistant layer can occur via a chemical, electrochemical or mechanical manner, depending on the type of the wear-resistant layer.

While preferred embodiments have been illustrated and described in detail in the drawings and foregoing description, the same are to be considered as illustrative and not restrictive in character, it being understood that only the preferred embodiments have been shown and described and that all changes and modifications that come within the spirit of the invention both now or in the future are desired to be protected.

We claim as our invention:

1. A method for producing a printing form for rotogravure, comprising the steps of:

providing a surface of the rotogravure printing form with a wear-resistant layer having a Vickers hardness greater than 110 kp/mm$^2$; and thereafter providing rotogravure cups, differing volumes of which determine differing corresponding tone values in the wear-resistant layer.

2. The method according to claim 1 wherein the wear-resistant layer is a layer made of a composite material.

3. The method according to claim 2 wherein the composite material is comprised of a mixture of a synthetic and particulate elements.

4. The method according to claim 3 wherein the particulate elements are formed from silica sand.

5. The method according to claim 1 wherein the wear-resistant layer comprises a metallic layer.

6. The method according to claim 5 wherein the metallic layer is comprised of chromium.

7. The method according to claim 1 wherein the layer is provided on the printing form by means of one of a PVD and a CVD method.

8. The method according to claim 5 wherein the metallic layer is galvanically provided on the printing form.

9. The method according to claim 1 wherein a thickness of the layer is selected such that the cups are only partially provided in the layer.

10. The method according to claim 1 wherein a thickness of the layer is selected so that the cups are completely provided in the layer.

11. The method according to claim 1 wherein the wear-resistant layer is between 20 to 50 $\mu$m thick.

12. The method according to claim 1 wherein a depth of the cups provided in the surface of the printing form is in a range between 15 and 35 $\mu$m.

13. The method according to claim 1 wherein the cups are provided in the wear-resistant layer via engraving.

14. The method according to claim 13 wherein the engraving occurs by means of a mechanical engraving unit.

15. The method according to claim 14 wherein the engraving occurs by means of laser light.

16. The method according to claim 15 wherein the cups are directly provided by means of laser light.

17. The method according to claim 1 wherein the cups are provided in the wear-resistant layer via etching.

18. The method according to claim 17 wherein before implementation of the etching event, one of a photoresist and a thermoresist is applied to the wear-resistant layer to form an etching mask.

19. The method according to claim 17 wherein the etching mask is illustrated by means of laser light.

20. The method according to claim 1 wherein a surface of the wear-resistant layer is designed rough with a predetermined degree of roughness.

21. The method according to claim 20 wherein the degree of roughness corresponds to that of microroughness.

22. The method according to claim 20 wherein the roughness is provided by at least one of polishing and grinding of the surface.

23. The method of claim 1 wherein the printing form is for heliorotogravure.

24. A printing form for rotogravure wherein a surface of the rotogravure printing form comprises a wear-resistant layer, the wear-resistant layer having a Vickers hardness greater than 110 kp/mm$^2$ and wherein the wear-resistant layer is designed for having rotogravure cups at least one of etched and engraved therein, differing volumes of the cups determining differing corresponding tone values.

25. The printing form according to claim 24 wherein the printing form is for heliorotogravure.

26. The printing form according to claim 24 wherein the wear-resistant layer is a layer made of a composite material.

27. The printing form according to claim 26 wherein the composite material is comprised of a mixture of a synthetic and particulate elements.

28. The printing form according to claim 27 wherein the particulate elements are formed from silica sand.

29. The printing form according to claim 24 wherein the wear-resistant layer comprises a metallic layer.

30. The printing form according to claim 29 wherein the metallic layer is comprised of chromium.

31. The printing form according to claim 24 wherein a thickness of the layer is selected such that the cups are only partially provided in the layer.

32. The printing form according to claim 24 wherein a thickness of the layer is selected so that the cups are completely provided in the layer.

33. The printing form according to claim 24 wherein the wear-resistant layer is between 20 to 50 $\mu$m thick.

34. The printing form according to claim 24 wherein a depth of the cups provided in the surface of the printing form is in a range between 15 and 35 $\mu$m.

35. The printing form according to claim 24 wherein the cups provided in the wear-resistant layer are engraved cups.

36. The printing form according to claim 24 wherein the cups provided in the wear-resistant layer are etched cups.

37. The printing form according to claim 24 wherein the cups are laser light engraved cups.

38. The printing form according to claim 24 wherein a surface of the wear-resistant layer is designed rough with a predetermined degree of roughness.

39. The printing form according to claim 38 wherein the degree of roughness corresponds to that of microroughness.

40. The printing form according to claim 38 wherein the roughness is provided by at least one of polishing and grinding of the surface.

41. A rotogravure printing form, comprising:

a core;

a wear-resistant layer overlying the core;

the wear-resistant layer having a Vickers hardness greater than 110 kp/mm$^2$; and the wear resistant layer being designed for at least one of engraving and etching of rotogravure cups therein where differing volumes of the cups determine differing corresponding tone values.

42. A printing form according to claim 41 wherein a base layer is provided between the wear-resistant layer and the core.

43. A printing form for rotogravure, comprising:

a core;

a wear-resistant layer overlying the core;

the wear-resistant layer having a Vickers hardness greater than 110 kg/mm$^2$;

cups engraved in the wear-resistant layer;

a base layer provided between the wear-resistant layer and the core; and wherein the cups extend through the wear-resistant layer and partially into said base layer.

44. A rotogravure printing form, comprising:

a core;

a wear-resistant layer overlying the core;

the wear-resistant layer having a Vickers hardness greater than 110 kp/mm$^2$; and rotogravure cups engraved in the wear-resistant layer, differing volumes of the cups determining differing corresponding tone values.

45. The form of claim 44 wherein a base layer is provided between the wear-resistant layer and the core and the wear-resistant layer has a hardness greater than a hardness of the base layer.

46. The form of claim 44 wherein the wear-resistant layer has a hardness greater than a hardness of the core.

47. The form of claim 44 wherein the wear-resistant layer is not copper.

* * * * *